United States Patent [19]

Witte

[11] 4,209,937

[45] Jul. 1, 1980

[54] TOY AIRCRAFT

[76] Inventor: Earl L. Witte, Rte. 6, Clinton Rd., Paducah, Ky. 42001

[21] Appl. No.: 892,254

[22] Filed: Mar. 31, 1978

[51] Int. Cl.[2] ..... A63H 27/14

[52] U.S. Cl. ..... 46/81; 46/44; 124/62

[58] Field of Search ..... 46/81, 74 B, 44, 1 R, 46/78, 79, 76 R, 80; 124/62

[56] References Cited

U.S. PATENT DOCUMENTS

| | | | |
|---|---|---|---|
| 1,609,013 | 11/1926 | De Cavin | 124/62 |
| 2,344,693 | 3/1944 | Gade | 46/79 |
| 2,820,321 | 1/1958 | Kuhn | 46/81 |
| 2,993,297 | 7/1961 | Bednar et al. | 46/74 B |
| 4,054,120 | 10/1977 | Foley | 124/62 |

FOREIGN PATENT DOCUMENTS

| | | | |
|---|---|---|---|
| 576750 | 4/1946 | United Kingdom | 46/81 |

*Primary Examiner*—Pitrelli John F.

*Attorney, Agent, or Firm*—Lowe, King, Price & Becker

[57] ABSTRACT

A toy airplane operable by air pressure through a blowpipe is designed to make effective use of the full air pressure supplied to the blowpipe to enhance its flight distance and speed. The airplane includes a tubular support member having a plugged front end and an open rear end into which the blowpipe is insertable. A cover member is mounted on the tubular support member and shaped to form an aircraft body with wing and tail elements. The tubular support member includes an annular accordion fold section spaced rearwardly from its front end to provide airtight sealing engagement with the blowpipe and to exert a gripping force on the blowpipe which must be overcome by the air pressure to launch the toy airplane into flight.

10 Claims, 6 Drawing Figures

TOY AIRCRAFT

FIELD OF THE INVENTION

The present invention relates to a toy aircraft operable by air pressure through a blowpipe and, more particularly, to a toy airplane which makes effective use of the full air pressure supplied to the blowpipe to enhance the flight distance and speed of the toy airplane.

SUMMARY OF THE PRIOR ART

Toy airplanes have been previously proposed which are launched into flight by air pressure through blowpipes. Such an airplane generally includes wing and tail elements mounted on a tubular body which is plugged at its front end to prevent air leakage and open at its rear end to receive a blowpipe. The airplane is propelled into flight by a puff of air supplied to the blowpipe, e.g., by blowing into the pipe or using a separate source of pressurized air. Typically, the tubular body is slightly larger in diameter than the blowpipe to permit the blowpipe to be easily inserted into the tubular body. Some prior designs have provided a loose fit between the tubular body and blowpipe to allow the airplane to slide relatively easily when a puff of air is applied to the blowpipe. However, such designs permit considerable air leakage in the space between the tubular body and blowpipe and thus make inefficient use of the total air pressure applied to the blowpipe. As a result, the operation is often unsatisfactory because a slight puff of air tends to move the airplane off the blowpipe through only a short distance of travel. The abbreviated flight of the airplane is not realistic and often results in the disappointment of the user.

Although various proposals have been made to more firmly retain the airplane body on the blowpipe, with the expectation of increasing the operating pressure required to propel the airplane to increase its speed and lengthen its distance of flight, such proposals have not been completely satisfactory. For example, it has been proposed to fasten the wing and tail elements on the tubular body by staples which also frictionally engage the blowpipe to increase the air pressure required to launch the airplane. However, since the staples leave a gap between the tubular body and blowpipe which allows air leakage, the full effect of the air pressure is not utilized. Alternatively, it has been proposed to provide a close fit between the inside diameter of the tubular body and the outside diameter of the blowpipe. Such an arrangement has the potential of providing an airtight seal between the tubular aircraft body and the blowpipe to make more effective use of the full air pressure. However, the close tolerances required often results in difficulty for the user, particularly children, in inserting the blowpipe into the aircraft body. Moreover, after repetitive use of the toy aircraft, there is a tendency for the tubular body and blowpipe to change in shape with a resultant loss of the close tolerances. Consequently, there is again a tendency for air leakage to occur which diminishes the effective use of the air pressure.

SUMMARY OF THE INVENTION

An object of the present invention is to provide a toy aircraft which is easy to assemble and realistic in flight.

It is also an object of the invention to achieve a toy aircraft operable by a puff of air through a blowpipe and capable of flight over relatively long distances.

Another object of the invention is to provide an improved toy aircraft incorporating a tubular support member adapted to provide an airtight seal with the blowpipe to effectively use the full air pressure supplied to propel the aircraft.

Another object of the invention is to achieve a toy aircraft in which the tubular support member is slightly larger in diameter than the blowpipe and includes a plurality of flexible, resilient accordian-like folds which provide reduced diameter serrations on the tubular support member for airtight engagement with the blowpipe.

A further object of the invention is to provide an improved toy airplane kit which is readily assembled and used by children.

The present invention is embodied in a toy aircraft adapted to be projected into flight by air pressure, which comprises a tubular support member having a front end and a rear end, a cover member adapted to be mounted on the tubular support member and shaped to form an aircraft body, means for sealing the front end of the tubular support member against air leakage, and a blowpipe insertable into the rear end of the tubular support member for supplying air pressure to its interior to propel the aircraft, wherein gripping means is formed on the tubular support member and spaced rearwardly from its front end for engaging the blowpipe to provide an airtight seal between the tubular support member and the blowpipe. Preferably, an annular accordian fold section is formed on the tubular support member. The fold section forms serrated edges which project inwardly into the interior for sealing engagement with the blowpipe. The tubular support member is larger in diameter than the blowpipe to provide a loose slidable fit, while the serrations of the fold section provide a reduced diameter portion of the tubular support member for airtight engagement and sliding resistance with the blowpipe.

In a preferred embodiment of the toy aircraft, a plug member, such as a wad of chewing gum, is insertable into the front end of the tubular support member to prevent air leakage. The plug member also advantageously forms a ballast for balancing the airplane in flight. The cover member which provides the aircraft body consists of a pair of stiff paper halves adapted to be fit together over the tubular support member and shaped to provide a fuselage with wing and tail elements. Preferably, the stiff paper halves are taped together along common edges thereof to form the fuselage and to reduce the aerodynamic resistance of the aircraft body.

The invention is also embodied in a toy airplane kit which is simple and easy to assemble. The kit includes a thin-walled, plastic tube having open front and rear ends and a stiff paper blank with portions adapted to be separated and fit together over the plastic tube to form an airplane body having a fuselage with wing and tail elements. The kit also includes a plug member such as a wad of chewing gum for sealing the front end of the plastic tube against air leakage, and a blowpipe insertable into the rear end of the plastic tube for supplying air pressure to its interior to propel the airplane. In addition, one or more annular folds providing internal serrations are formed on the plastic tube thereby making up the accordion fold section spaced rearwardly from its front end for engagement with the blowpipe to provide an airtight seal between the plastic tube and blowpipe.

BRIEF DESCRIPTION OF THE DRAWINGS

The accompanying drawings illustrate a preferred embodiment of the present invention and, together with the description, serve to explain the principles of the invention.

DETAILED DESCRIPTION OF THE PREFERRED EMBODIMENT

Figure 1:
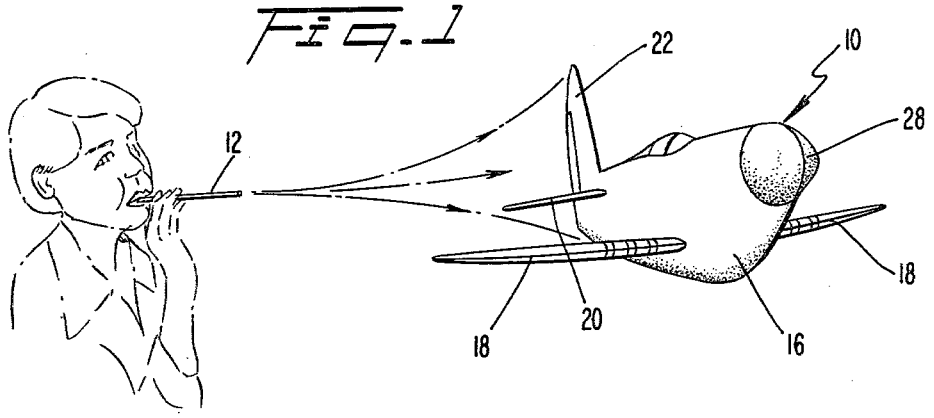
FIG. 1 illustrates a child using a blowpipe to propel a toy aircraft constructed according to the present invention.

Referring to FIG. 1, the present invention is embodied in a toy airplane, generally 10, which is projected into flight by a puff of air through a blowpipe 12. The airplane includes a tubular support member 14 (FIGS. 2 and 3) which is preferably a thin-walled round plastic tube having an open front end prior to assembly and an open rear end for receiving blowpipe 12. The blowpipe also consists of a thin-walled round plastic tube. The inside diameter of plastic tube 14 is slightly larger than the outside diameter of blowpipe 12 to allow a loose, freely slidable fit between the blowpipe and plastic tube.

Figure 2:
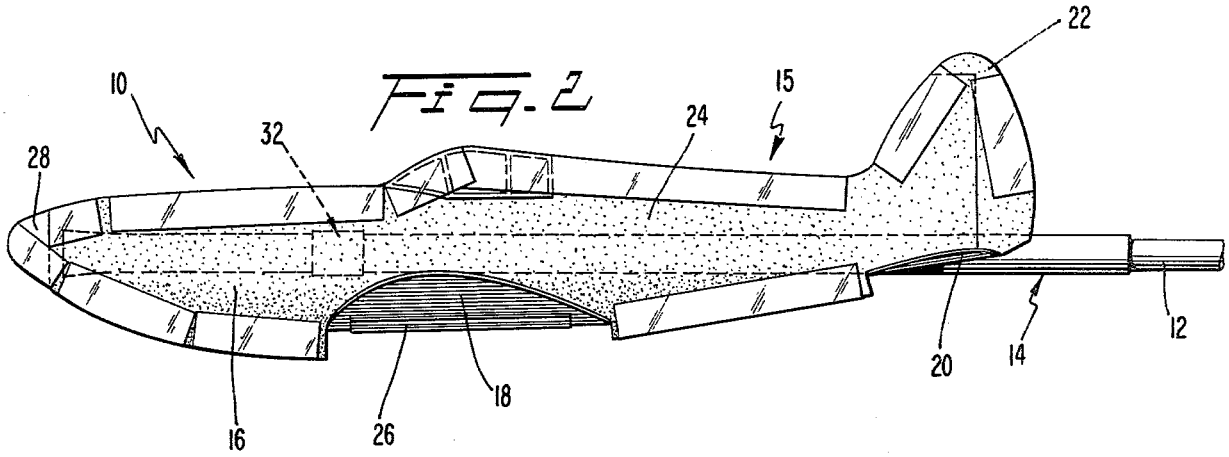
FIG. 2 is a side elevation of the toy aircraft illustrating a cover member formed in the shape of an airplane body and mounted on a plastic tube into which the blowpipe is inserted.
Figure 3:
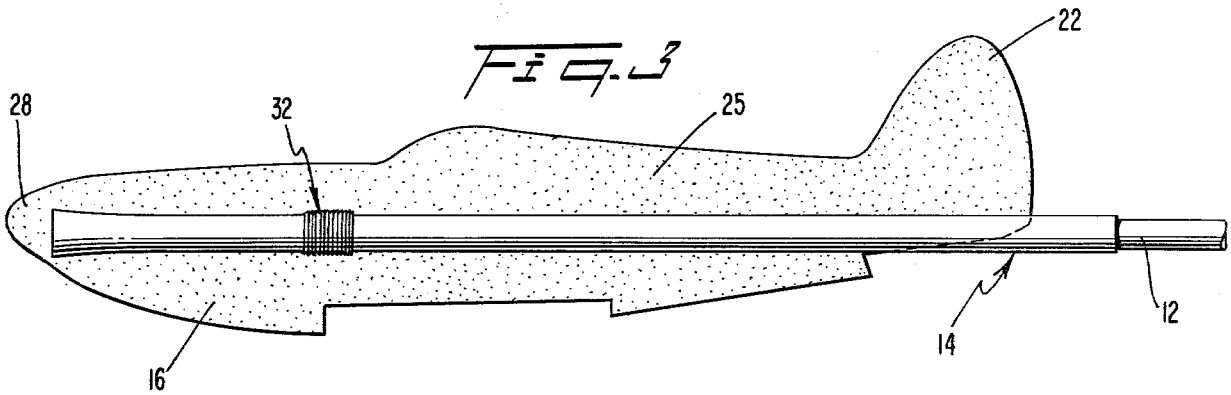
FIG. 3 is a side elevation of the toy aircraft with one-half of the cover member removed.
Figure 5:
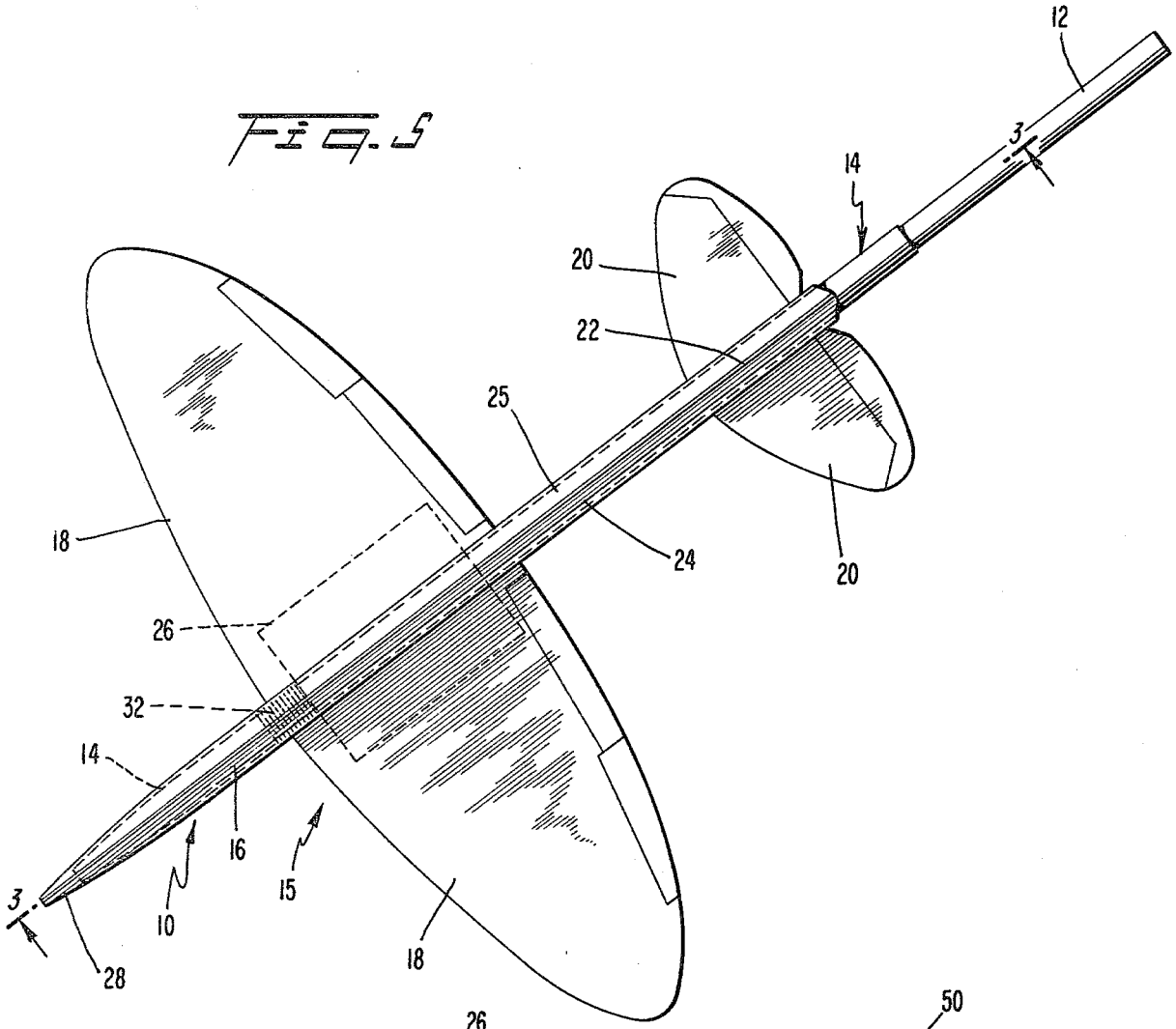
FIG. 5 is a plan view of the toy aircraft.

As shown in FIGS. 2 and 5, a cover member 15, preferably made of stiff paper, is formed into the shape of an airplane body and mounted on plastic tube 14. The airplane body includes a fuselage 16, a pair of front wings 18, a pair of rear wings 20 and a tail 22. Preferably, the cover member which forms the airplane body comprises a pair of stiff paper halves 24 and 25 (FIG. 5) forming opposite sides of the airplane body and adapted to be fit together over plastic tube 14. The stiff paper halves may be taped together along their common edges, e.g., by transparent cellophane tape. Plastic tube 14 is inserted through an opening beneath tail 22 to extend lengthwise along fuselage 16 of the airplane body.

In the preferred embodiment, a wing spar 26 (FIGS. 2 and 5), e.g., a rectangular piece of stiff paper, is secured to the underside of each front wing 18 to reinforce the airplane body and hold the front wings in a desired orientation. Preferably, as shown in FIG. 2, each front wing 20 is inclined slightly upward for optimum flight characteristics. Wing spar 26 may be fastened to the wings by lengths of transparent cellophane tape.

The airplane body includes a spinner or nose 28 (FIGS. 1 and 2) which may be weighted to provide desired flight characteristics. Preferably, a wad of chewing gum in the tube 14 forms this ballast. Additionally, more gum may be attached to the inside of stiff paper halves 24 and 25 (FIG. 5) adjacent to nose 28 to thus provide any desired spinner weight.

Figure 4:
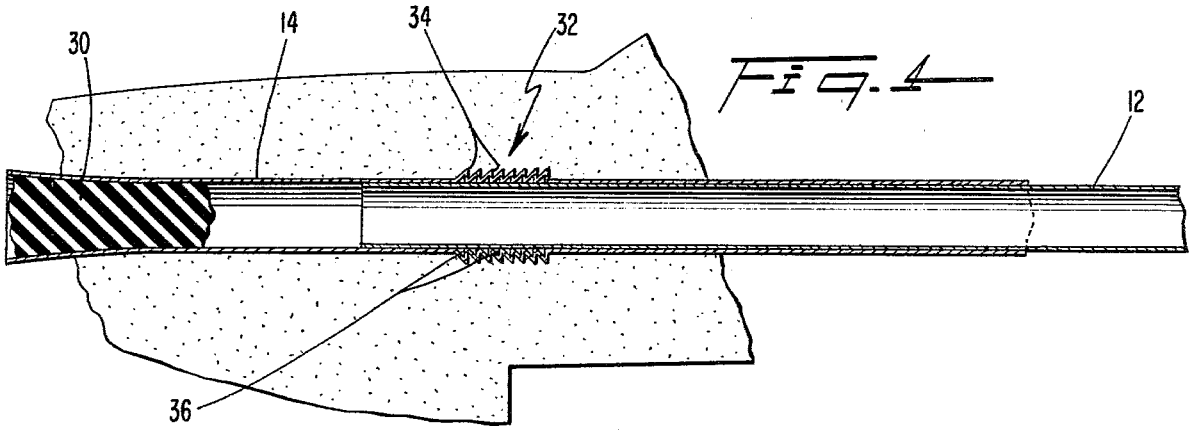
FIG. 4 is an enlarged vertical section of the plastic tube showing a plug member inserted into its front end and a plurality of annular folds providing serrations formed on the tube for airtight engagement with the blowpipe.

As shown in FIG. 4, the wad of gum forms a discrete plug 30 and thus provides for sealing the front end of plastic tube 8 against air leakage. Plug 30 may be formed of any other suitable material which can be readily molded into a cylindrical shape to fit inside the front end of plastic tube 14. Preferably, the plug consists of a wad of bubble gum, to make the toy airplane more interesting to assemble by children. The plug provides an airtight seal to prevent air leakage from the front end of plastic tube 14 when air pressure is supplied through blowpipe 12 to propel the toy airplane.

Plug 30 and the spinner weight at nose 28 are thus relatively heavy in comparison with plastic tube 14 and paper airplane body 16. This ballast locates the center of gravity toward the front end of the airplane to provide for optimum flight characteristics.

In accordance with the present invention, the toy aircraft includes a sealing section and gripping means formed on its tubular support member and spaced rearwardly from its front end for engaging the blowpipe upon its insertion therein. Preferably, an accordion fold section, generally 32 (FIGS. 3 and 4), forms this sealing means. As shown in FIG. 2, this sealing section of the plastic tube 14 is located slightly forward of front wings 18 of the airplane body.

Referring to FIG. 4, the sealing section of plastic tube 14 specifically consists of a plurality of annular folds with inner closely spaced folds 34 which provide a series of inwardly projecting annular serrations 36 within the interior of the plastic tube. Inwardly projecting annular serrations 36 provide a series of reduced diameter portions on plastic tube 14 for airtight engagement with and grippng of blowpipe 12.

Preferably, blowpipe 12 is made of resilient, plastic material. The plastic material is sufficiently flexible to allow the blowpipe 12 to be slightly compressed inwardly when it is inserted into plastic tube 14 and moved into engagement with annular serrations 36 provided by folds 34. In addition, the serrated portion of plastic tube 14 is also slightly resilient to provide some flexibility. Thus, when blowpipe 12 is inserted into plastic tube 14 and moved through its fold section 32, annular serrations 36 may be slightly deformed and pushed outwardly to effect the airtight seal between the plastic tube and blowpipe.

In the operation of the toy airplane, blowpipe 12 is initially inserted into the rear end of plastic tube 14. The blowpipe moves freely through the interior of the plastic tube until its front end arrives at annular fold section 32 of the plastic tube. Then, a slight push is required to move the front end of blowpipe 12 past annular serrations 36 to the position shown in FIG. 4. This provides an airtight seal between plastic tube 14 and blowpipe 12. In addition, the gripping force exerted on the outside of blowpipe 12 by the serrations must now be overcome to launch the toy airplane.

To project the toy airplane into flight, air pressure is supplied through blowpipe 12 to the interior of plastic tube 14. For example, a child can launch the airplane by blowing into the rear end of blowpipe 12. By applying a sufficient puff of air through blowpipe 12, a propelling force is produced which is sufficient to overcome the gripping force exerted by annular serrations 36. The action efficiently projects the toy airplane 10 into flight. The airtight seal prevents air leakage through the rear end of plastic tube 14 to effectively convert the entire amount of air pressure into the propelling force which launches the toy airplane. In addition, since a relatively large air pressure is required to overcome the gripping force or telescoping slide resistance exerted on blowpipe 12 by annular serrations 36, the toy aircraft is propelled over relatively long distances of flight at high speed.

Figure 6:
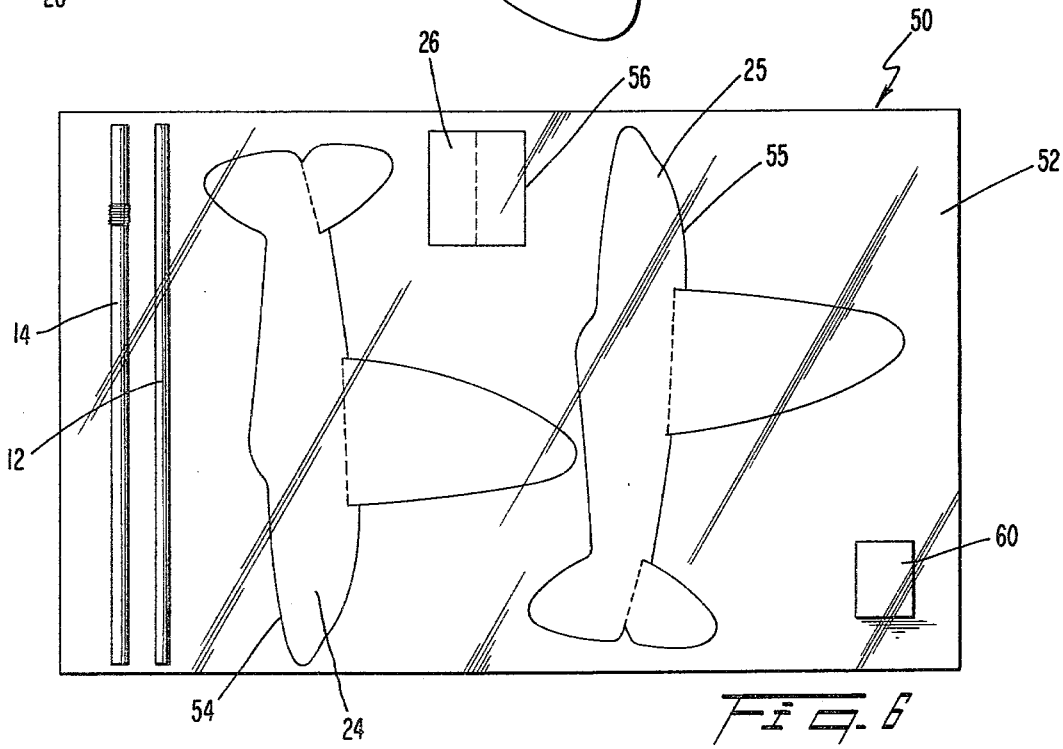
FIG. 6 illustrates an assembly kit for the toy aircraft of the present invention.

Referring to FIG. 6, the invention is also embodied in a toy airplane kit, generally 50, including a stiff paper blank 52 having separate portions 54 and 55 which are shaped into appropriate configurations to form opposite halves 24 and 25, respectively, of the airplane body. Stiff paper blank 52 also includes a rectangular portion 56 which provides wing spar 26 for the toy airplane.

Preferably, portions 54, 55 and 56 of the stiff paper blank are defined by solid lines along which the paper is cut to form airplane body halves 24 and 25 and wing spar 26. Dotted lines indicate portions of the stiff paper blank to be folded, e.g., to bend the airplane wings into place. Alternatively, portions 54, 55 and 56 may be partially punched out along the solid outlines to facilitate separation of these portions from stiff paper blank 52.

In addition, the toy airplane kit includes thin-walled plastic tube 14 and blowpipe 16. The kit also includes a package 60 of bubble gum which can be used to form the spinner weight at nose 28 and plug member 30 of the toy airplane.

In the assembly of the toy airplane kit, airplane body halves 24 and 25 are cut out along the solid lines from stiff paper blank 52 and fit together. A portion of the bubble gum, after chewing, is attached to the inside of stiff paper halves 24 and 25 to provide the spinner weight at nose 28 of the toy airplane. The edges of the airplane body halves are taped together using strips of cellophane tape. Front wings 18 and rear wings 20 are folded upwardly along the dotted fold lines.

Next, a round pencil or similar piece of wood is inserted into fuselage 16 through the opening beneath tail 22. Rectangular wing spar 26 is cut from stiff paper blank 52 and taped across the underside of each front wing 20 for reinforcement. Preferably, as shown in FIG. 2, each front wing 20 is inclined upwardly for optimum flight characteristics.

Another piece of bubble gum is formed into an elongated cylindrical shape and inserted into the front end of plastic tube 14 to seal the tube and form more ballast. The pencil is removed from the fuselage and plugged tube 14 is inserted into the airplane body with its front plugged end near spinner or nose 28 of the toy airplane and its open rear end extending beneath the tail. The resiliency of stiff paper halves 24 and 25 tends to hold airplane body 15 in place on the plastic tube, especially against the outer serrations of the folds 34.

The present invention is not limited to the specific details shown and described, and modifications may be made to the toy aircraft and kit without departing from the principles of the present invention.

What is claimed is:

1. A toy aircraft adapted to be projected into flight by air pressure, comprising:

a tubular support member having a front end and a rear end;

a cover member adapted to be mounted on said tubular support member and shaped to form an aircraft body;

means for sealing said front end of said tubular support member against air leakage;

a blowpipe insertable into said rear end of said tubular support member for supplying air pressure to the interior thereof to propel the aircraft; and flexible gripping means formed on said tubular support member and spaced rearwardly from said front end thereof for engaging said blowpipe upon its insertion therein to provide an airtight seal and sliding resistance between said tubular support member and said blowpipe, said flexible gripping means comprises an annular section formed on said tubular support member projecting inwardly into the interior thereof for engagement with said blowpipe.

2. The toy aircraft of claim 1, wherein said annular section comprises:

a fold section formed on said tubular support member with serrations.

3. The toy aircraft of claim 2, wherein:

said tubular support member is larger in diameter than said blowpipe to provide a loose, slidable fit therebetween; and said fold section provides a reduced diameter portion of said tubular support member for airtight engagement with said blowpipe.

4. The toy aircraft of claim 1, wherein said sealing means comprises:

a plug insertable into said front end of said tubular support member.

5. The toy aircraft of claim 4, wherein said plug consists of chewing gum.

6. The toy aircraft of claim 2, wherein said cover member comprises:

a pair of stiff paper halves adapted to be fit together over said tubular support member and shaped to provide a fuselage with wing and tail elements, said cover member engaging the outer serrations of said fold section to prevent separation.

7. The toy aircraft of claim 6, wherein:

said stiff paper halves are taped together along common edges thereof to hold the halves together and to reduce the aerodynamic resistance of the aircraft body.

8. A toy airplane kit, comprising:

a thin-walled plastic tube having an open front end and an open rear end;

a stiff paper blank having portions thereof adapted to be separated therefrom and fit together over said plastic tube to form an airplane body having a fuselage with wing and tail elements;

a plug member for sealing said front end of said plastic tube against air leakage;

a flexible blowpipe insertable into said rear end of said plastic tube for supplying air pressure to the interior thereof to propel the airplane; and one or more annular folds formed on one of said plastic tube or blowpipe and spaced rearwardly from said front end providing inner serrations for interengaging said blowpipe upon insertion of the blowpipe to compress the blowpipe inwardly and provide an airtight seal and sliding resistance between said plastic tube and said blowpipe.

9. The toy airplane kit of claim 8, wherein said plug member consists of chewing gum.

10. The toy airplane kit of claim 8, wherein:

said plastic tube is larger in diameter than said blowpipe to provide a loose, slidable fit therebetween; and said folds are formed on said tube to provide reduced diameter serrations on said plastic tube for airtight engagement with said blowpipe and increased telescoping slide resistance.

* * * * *